US009193565B2

(12) United States Patent
Piech

(10) Patent No.: US 9,193,565 B2
(45) Date of Patent: Nov. 24, 2015

(54) ROLLER GUIDE WITH SPEED DEPENDENT STIFFNESS

(75) Inventor: Zbigniew Piech, Wolcott, CT (US)

(73) Assignee: Otis Elevator Company, Farmington, CT (US)

( * ) Notice: Subject to any disclaimer, the term of this patent is extended or adjusted under 35 U.S.C. 154(b) by 1866 days.

(21) Appl. No.: 12/298,787

(22) PCT Filed: May 22, 2006

(86) PCT No.: PCT/US2006/019558
§ 371 (c)(1),
(2), (4) Date: Aug. 14, 2009

(87) PCT Pub. No.: WO2007/136370
PCT Pub. Date: Nov. 29, 2007

(65) Prior Publication Data

US 2009/0294222 A1 Dec. 3, 2009

(51) Int. Cl.
*B66B 7/04* (2006.01)
*B61B 12/04* (2006.01)

(52) U.S. Cl.
CPC ..... *B66B 7/048* (2013.01); *B66B 7/046* (2013.01); *B61B 12/04* (2013.01); *B66B 7/042* (2013.01)

(58) Field of Classification Search
CPC ..... B66B 7/042; B66B 7/046; B66B 7/048; B61B 12/02; B61B 12/04
USPC ..... 187/251, 264, 292, 345, 406, 393, 410; 74/473.29, 604, 574.4; 248/638, 317; 188/378, 290; 254/277, 392; 104/245, 104/247
IPC ..... B66B 5/00,1/34
See application file for complete search history.

(56) References Cited

U.S. PATENT DOCUMENTS

| | | | | | |
|---|---|---|---|---|---|
| 3,797,403 | A | * | 3/1974 | Schwarzler et al. | 104/284 |
| 4,497,393 | A | | 2/1985 | Brems | |
| 5,290,821 | A | * | 3/1994 | Sakurai et al. | 521/82 |
| 5,368,132 | A | * | 11/1994 | Hollowell et al. | 187/393 |
| 5,379,864 | A | * | 1/1995 | Colby | 187/393 |
| 5,607,996 | A | * | 3/1997 | Nichols et al. | 524/439 |
| 5,864,102 | A | * | 1/1999 | Jamieson et al. | 187/292 |

(Continued)

FOREIGN PATENT DOCUMENTS

| | | | | |
|---|---|---|---|---|
| JP | 01317977 | A * | 12/1989 | B66B 5/02 |
| JP | 7010419 | | 1/1995 | |

(Continued)

OTHER PUBLICATIONS

Search Report and Written Opinion mailed on Feb. 15, 2007 for PCT/US06/19558.

(Continued)

*Primary Examiner* — Emmanuel M Marcelo
*Assistant Examiner* — Stefan Kruer
(74) *Attorney, Agent, or Firm* — Carlson, Gaskey & Olds, P.C.

(57) ABSTRACT

A guide device (26) for use in an elevator system includes an elevator guide roller (30) having a hardness that varies depending on a speed of rotation of the guide roller (30). In a disclosed example, a magnetorheological fluid within the guide roller (30) changes viscosity depending on the speed of rotation. One example includes varying an influence of a first magnetic field on the magnetorheological fluid to change the viscosity.

30 Claims, 1 Drawing Sheet

(56) References Cited

U.S. PATENT DOCUMENTS

| | | | | |
|---|---|---|---|---|
| 6,186,290 | B1 * | 2/2001 | Carlson | 188/164 |
| 6,338,396 | B1 * | 1/2002 | Morishita | 187/292 |
| 6,681,905 | B2 * | 1/2004 | Edmondson et al. | 188/267.2 |
| 7,086,507 | B2 * | 8/2006 | Hitchcock et al. | 188/267.2 |
| 7,137,634 | B2 * | 11/2006 | Oh | 280/5.516 |
| 7,261,834 | B2 * | 8/2007 | Fuchs et al. | 252/62.53 |
| 7,543,686 | B2 * | 6/2009 | Kulak et al. | 187/292 |
| 2004/0016486 | A1 * | 1/2004 | Tropper | 152/151 |
| 2004/0163904 | A1 * | 8/2004 | Anderfaas | 188/267.2 |
| 2005/0023052 | A1 | 2/2005 | Beck et al. | |
| 2006/0016649 | A1 | 1/2006 | Gordaninejad et al. | |
| 2006/0065775 | A1 * | 3/2006 | Smith et al. | 244/3.23 |
| 2007/0215421 | A1 * | 9/2007 | Anderfaas | 188/267.2 |
| 2008/0110701 | A1 * | 5/2008 | Ito et al. | 187/292 |
| 2008/0207418 | A1 * | 8/2008 | Van Haag | 492/7 |
| 2010/0314015 | A1 * | 12/2010 | Rodenbeck | 152/418 |

FOREIGN PATENT DOCUMENTS

| | | | | |
|---|---|---|---|---|
| JP | 2002187679 | | 7/2002 | |
| JP | 2002345911 | | 12/2002 | |
| JP | 2006264579 | A * | 10/2006 | F16F 9/14 |
| WO | WO2004099054 | | 11/2004 | |

OTHER PUBLICATIONS

Transmittal of International Preliminary Report on Patentability mailed Sep. 18, 2007.

* cited by examiner

ROLLER GUIDE WITH SPEED DEPENDENT STIFFNESS

FIELD OF THE INVENTION

This invention generally relates to elevator systems. More particularly, this invention relates to guide systems for elevators.

DESCRIPTION OF THE RELATED ART

Elevator systems typically include a car that travels vertically within a hoistway to transport passengers or cargo between different floors within a building. Guide rails extend through the hoistway to guide movement of the car. A guide system associated with the car follows along the guide rails. Typical systems include guide devices having sliding guide shoes or guide rollers.

A common difficulty associated with conventional systems is that any misalignment of the guide rails or irregularities in the guide rail surfaces reduce the ride quality of the elevator system. Inconsistencies in the alignment or surfaces of the guide rails can result in vibrations felt by passengers, for example.

There have been attempts at minimizing such vibrations by including springs on roller guide assemblies that allow the rollers some movement relative to the guide device and car frame as the rollers are riding along the rail surface. A significant shortcoming of using springs is that a spring has only one stiffness that is set during installation. Over time it may be desirable to change that stiffness but that is not readily accomplished with springs. Additionally, the adjustments necessary during installation to achieve a desired elevator ride quality are fairly involved, requiring time and introducing additional expense into the elevator installation operation.

WO2004/099054 discloses an elevator system having an active control for varying a hardness of a roller. A sensor senses vibration within the elevator system, and a controller adjusts the hardness of the roller responsive to the sensed vibration. One drawback of using an active control is that a control strategy that utilizes decision algorithms and electronics may be needed, which is expensive and complicates the elevator system.

There is a need for a simplified elevator guide device that will enhance ride quality. This invention addresses those needs while avoiding the shortcomings and drawbacks of the prior art.

SUMMARY OF THE INVENTION

One example guide device for use in an elevator system includes an elevator guide roller having a hardness that varies depending on a speed of rotation of the roller.

One example method includes varying a hardness of an elevator guide roller in response to a speed of rotation of the elevator guide roller.

The various features and advantages of this invention will become apparent to those skilled in the art from the following detailed description. The drawings that accompany the detailed description can be briefly described as follows.

DETAILED DESCRIPTION

Figure 1:
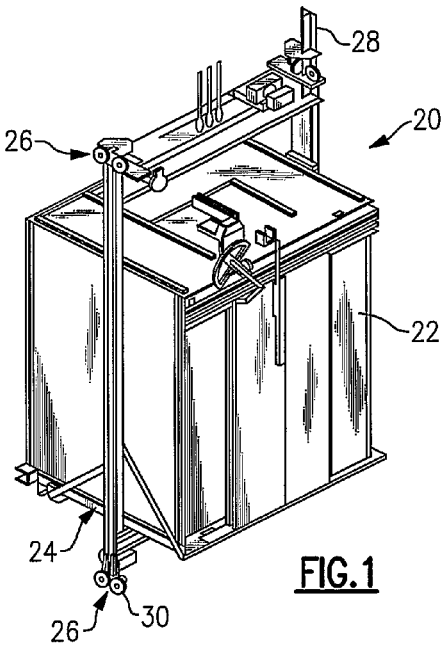
FIG. 1 illustrates an elevator car assembly including a guide device.

FIG. 1 illustrates an elevator car assembly 20 that includes a cabin 22 supported on a car frame 24. A plurality of roller guide devices 26 guide movement of the car assembly 20 along guide rails 28 (only one is shown) as the car assembly 20 moves in a conventional manner through a hoistway, for example. The guide devices 26 include a plurality of guide rollers 30. In the illustrated example, the guide rollers 30 roll along the guide rails 28 during movement of the car assembly 20.

The guide rollers 30 in this example have a variable hardness to control the amount of vibration between the guide rails 28 and the car frame 24. This provides the benefit of enhancing the ride quality of the car assembly 20.

Figure 2:
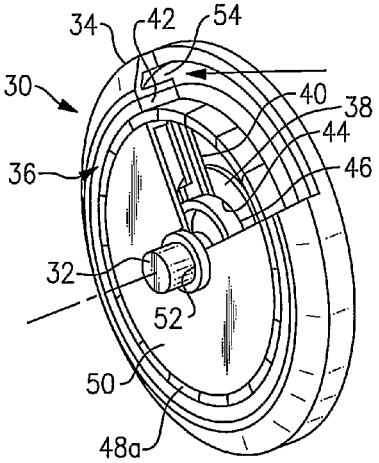
FIG. 2 illustrates one example elevator guide roller of the guide device shown in FIG. 1.
Figure 3:
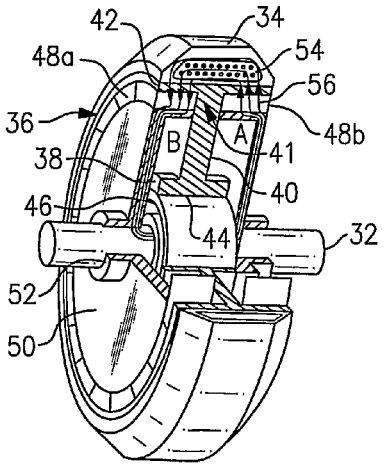
FIG. 3 illustrates one example of the operation of an elevator guide roller in a stationary condition.

One example guide roller 30 is shown in FIGS. 2 and 3. In this example, the guide roller 30 rotates about a shaft 32 which is supported by the guide device 26 in a known manner. In this example, a tire 34 is mounted on a hub 36. The hub 36 includes an inner ring section 38 having spokes 40 that extend in an outward direction and form a connection 41 with a flange 42. In this example, the tire 34 is secured to the outer surface of the flange 42 in a known manner, such as with an adhesive. The inner ring section 38 of the hub 36 includes an opening 44 that receives a bearing 46. The bearing 46 allows the hub 36 and tire 34 to rotate in unison about the shaft 32.

In the disclosed example, the connection 41 forms two sides of the spokes 40, side A and side B. Magnetic members 48*a* and 48*b* are received adjacent the inner surface of the flange 42, one on side A and the other on side B. In this example, each magnetic member 48*a* and 48*b* comprises a ring. Given this description, one of ordinary skill in the art will recognize alternative magnetic member configurations to suit their particular needs. A support member 50 having an opening 52 is received onto the shaft 32. In this example, one support member 50 is received onto each side A and side B to maintain the respective magnetic members 48*a* and 48*b* adjacent the flange 42.

As can be appreciated by the cut-away portions of the illustrations, the tire 34 includes a cavity 54. In one example, the cavity 54 is at least partially filled with a fluid that has a selectively variable viscosity. One example includes a magnetorheological fluid. In one example, the cavity 54 is filled with magnetorheological fluid to a desired level such that little or no air remains in the cavity 54. The term magnetorheological fluid as used in this description refers to a fluid that changes viscosity in response to a changing magnetic field. In one example, the magnetorheological fluid includes suspended magnetic particles that polarize and form columnar structures parallel to the magnetic field in a known manner to increase the viscosity of the fluid (i.e., increase the hardness of the tire or roller).

The guide roller 30 is mounted to follow or roll along the rail 28 such that the tire 34 contacts a surface of the rail 28. When the car assembly 20 moves along the guide rails 28, the tire 34 and the hub 36 rotate about the shaft 32. The magnetic members 48*a* and 48*b* and the support 50 remain stationary relative to the shaft 32 and do not rotate with the tire 34 and the hub 36 during the car assembly 20 movement such that the tire 34 and magnetorheological fluid in the cavity 54 rotate relative to a magnetic field produced by the magnetic members 48*a* and 48*b*.

As seen in FIG. 3, when the car assembly 20 is stationary, the magnetic field 56 produced by the magnetic members 48*a* and 48*b* penetrates the cavity 54 with a generally constant magnetic flux. In response, the magnetorheological fluid increases in viscosity to harden the tire 34. At low rotational speeds corresponding to relatively slow elevator car movement, or a stationary position, there is little or no vibration and a harder tire 34 is desired for providing sufficient ride quality. Additionally, during loading and unloading, the harder tire 34 provides the benefit of reducing or minimizing cabin movement that would otherwise occur with the changing load in the cabin.

The hardening of the magnetorheological fluid also resists compression of the tire 34. This provides the benefit of reducing or eliminating permanent flattening of the tire 34 from extended periods of compression (e.g., when an elevator car remains stationary for a considerable time), which is a problem encountered with rollers in some prior guide systems that leads to permanently deformed rollers.

Figure 4:
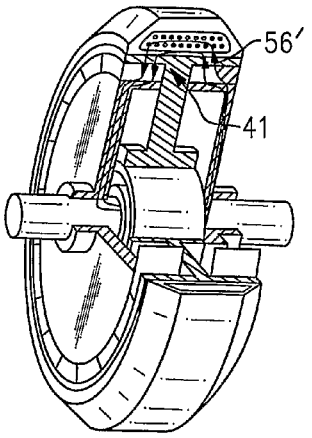
FIG. 4 illustrates one example of the operation of an elevator guide roller in a rotational condition.

As the car assembly 20 moves and the tire 34 and hub 36 rotate relative to the magnetic members 48*a* and 48*b*. The movement of the hub 36 within the magnetic field 56 generated by magnetic members 48*a* and 48*b* produces eddy currents within the flange 42 of the hub 36. The eddy currents generate a second magnetic field that, in this example, opposes the magnetic field 56 produced by the magnetic members 48*a* and 48*b*. The second magnetic field has the effect of reducing an influence of the magnetic field 56 on the fluid in the cavity 54. FIG. 4 schematically shows a resulting, or influenced, magnetic flux 56', which has a smaller magnetic influence on the fluid in the cavity 54. The interaction between a magnetic field, an induced electric current, and the magnetic field associated with the electric current are well known. Given this description, one of ordinary skill will understand the principles upon which the disclosed examples are based.

The second magnetic field, which results from rotation of the hub 36 within the first magnetic field 56 reduces the magnetic flux (e.g., the influence of the first magnetic field) through the cavity 54 of the tire 34. In this regard, the flange 42 can be considered an interference member to reduce the magnetic flux through the cavity 54. The reduction in the magnetic flux allows the magnetorheological fluid to become less viscous, which softens the tire 34 and allows the tire 34 to compress responsive to any vibrational forces between the guide rails 28 and the car assembly 20. This provides the benefit of increased damping for enhanced ride quality.

In the disclosed example, the flange 42 is made of an electrically conductive, non-ferromagnetic material to conduct the eddy current and provide the second magnetic field. In one example, the flange 42 is made of an aluminum material. In another example, a material with even greater electrical conductivity is used produce a second magnetic field of a relatively higher magnitude, which provides increased opposition to the magnetic field 56 produced by the magnetic members 48*a* and 48*b* for an enhanced softening effect. In another example, a material with a lesser electrical conductivity is used to produce a second magnetic field having a relatively lower magnitude, which provides less opposition to the magnetic field 56 produced by the magnetic members 48*a* and 48*b* for less of a softening effect. Given this description, one of ordinary skill in the art will recognize suitable materials to meet their particular needs.

In the disclosed example, the viscosity of the magnetorheological fluid varies in response to the rotational speed of the tire 34 without the use of active controls. In this example, at low speeds, relatively weak eddy currents are produced within the flange 42. The relatively weak eddy currents produce a relatively weak second magnetic field and most of the magnetic field 56 produced by the magnetic members 48*a* and 48*b* penetrates the cavity 54 such that the magnetorheological fluid is relatively viscous. At higher speeds, relatively higher eddy currents are produced within the flange 42. This produces a relatively stronger second magnetic field, which provides greater influence on the magnetic field 56 generated by the magnetic members 48*a* and 48*b*. Thus, less of the magnetic field 56 produced by the magnetic members 48*a* and 48*b* has less of an influence in the cavity 54, and the magnetorheological fluid becomes less viscous in response. This provides the benefit of controlling the ride quality passively in response to the rotational speed of the tire 34 without having to use an active control strategy or algorithms to vary the magnetic field based upon sensor signals.

In the illustrated example, the tire 34 is made of a material suitable for forming the cavity 54 and holding the magnetorheological fluid. In one example, the tire 34 is made of a polymeric material and is formed into the tire 34 shape in a known manner. In another example, an elastomeric polymer is used to provide the benefit of additional damping. If the tire 34 material is too stiff however, the tire 34 will transfer vibrations between the guide rails 28 and the car assembly 20 without allowing the cavity 54 and magnetorheological fluid to compress. This diminishes the damping effect of the magnetorheological fluid. In one example, the tire is made of a polyurethane material. In another example, the tire 34 is made of a silicone material. Given this description, one of ordinary skill will recognize suitable tire materials to meet their particular needs.

The disclosed example provides enhanced ride quality without undesirably complicating an elevator guide roller assembly. Having a roller with a hardness that varies with speed of rotation facilitates ride quality by automatically providing more stiffness at low speeds and less stiffness at higher speeds to dampen vibrations that may become more apparent at higher speeds. Additionally, greater stiffness when an elevator is stopped at a landing helps to reduce car movement or vibration during loading or unloading.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A guide device for use in an elevator system, comprising: an elevator guide roller having a hardness that varies depending on a speed of rotation of the roller, and wherein a variation in the speed of rotation of the roller directly causes the hardness of the roller to vary.

2. The guide device as recited in claim 1, wherein the elevator guide roller comprises a tire having a tire cavity that is at least partially filled with a magnetorheological fluid.

3. The guide device as recited in claim 2, comprising a magnet that generates a first magnetic field for changing a viscosity of the magnetorheological fluid to change the hardness of the elevator guide roller.

4. The guide device as recited in claim 3, wherein the magnet is supported so that the tire and an electrically conductive member supporting the tire rotate relative to the magnet as the elevator guide roller rotates.

5. The guide device as recited in claim 4, wherein the magnet comprises a ring supported on a shaft.

6. The guide device as recited in claim 5, wherein the elevator guide roller comprises a bearing mounted on the shaft and the electrically conductive member comprises a hub that is at least partially between the magnet and the tire cavity and is coupled for rotation with the bearing.

7. The guide device as recited in claim 6, wherein the hub comprises an electrically conductive, non-ferromagnetic material.

8. The guide device as recited in claim 3, comprising an interference member at least partially within the first magnetic field to vary an influence of the first magnetic field on the magnetorheological fluid.

9. The guide device as recited in claim 8, wherein the interference member produces a second magnetic field that opposes the first magnetic field.

10. The guide device as recited in claim 8, wherein the interference member comprises an electrically conductive, non-ferromagnetic material.

11. The guide device as recited in claim 8, wherein the interference member is at least partially between the magnet and the fluid.

12. The guide device as recited in claim 1, wherein the elevator guide roller includes a fluid having a variable viscosity that provides the variable hardness.

13. The guide device as recited in claim 12, wherein the viscosity of the fluid varies in response to the speed of rotation to provide a variable amount of damping of vibrational movement of an associated elevator car.

14. The guide device as recited in claim 1, including a magnet within a hub of the roller.

15. The guide device as recited in claim 14, wherein the magnet is fixedly mounted on a shaft around which the roller rotates.

16. The guide device as recited in claim 15, wherein the magnet is entirely radially inwards of a tire cavity of the roller in which a magnetorheological fluid is contained.

17. The guide device as recited in claim 1, wherein the elevator guide roller includes a tire having a tire cavity that is at least partially filled with a magnetorheological fluid, the tire being mounted on a hub that includes a ring section, a flange located radially outwardly of the ring section and spokes that join to the ring section and the flange.

18. The guide device as recited in claim 17, further comprising magnetic members adjacent an inner surface of the flange.

19. The guide device as recited in claim 18, wherein the magnetic members are located on respective opposed sides of the spokes.

20. The guide device as recited in claim 19, further comprising support members respectively received onto each of the opposed sides and holding the respective magnetic members adjacent the flange.

21. The guide device as recited in claim 17, wherein the tire is secured to an outer surface of the flange.

22. The guide device as recited in claim 1, wherein the hardness varies depending on the speed of rotation of the roller, without use of an active control.

23. The guide device as recited in claim 1, wherein the hardness varies inversely to the speed of rotation of the roller.

24. A method comprising:

varying a hardness of an elevator guide roller in response to a speed of rotation of the elevator guide roller without use of an active control or electronic signaling.

25. The method as recited in claim 24, including varying a viscosity of a magnetorheological fluid within the elevator guide roller.

26. The method as recited in claim 25, including varying an influence of a first magnetic field on the magnetorheological fluid to change the viscosity of the magnetorheological fluid.

27. The method as recited in claim 26, including varying a second magnetic field to vary the influence of the first magnetic field on the magnetorheological fluid.

28. The method as recited in claim 25, including increasing the viscosity of the magnetorheological fluid in response to a first rotational speed of the elevator guide roller and decreasing the viscosity in response to a second, greater rotational speed of the elevator guide roller.

29. The method as recited in claim 24, wherein the varying of the hardness includes:

providing a magnet that generates a magnetic field to influence a viscosity of a magnetorheological fluid in a tire of the elevator guide roller to change the hardness of the tire; and using an interference member located at least partially within the magnetic field to passively, free of the any sensor signals provided to the interference member and the magnet, vary an influence of the magnetic field on the viscosity of the magnetorheological fluid in dependence upon the speed of rotation.

30. A guide device for use in an elevator system, comprising:

an elevator guide roller including a tire having a tire cavity that is at least partially filled with a magnetorheological fluid, the tire having a hardness;

a magnet operable to generate a magnetic field to change a viscosity of the magnetorheological fluid to change the hardness of the tire; and an interference member at least partially within the magnetic field, the interference member passively, free of any sensor signals to the interference member and the magnet, varying an influence of the magnetic field on the magnetorheological fluid in dependence upon a speed of rotation of the elevator guide roller.

* * * * *